United States Patent [19]

Kern et al.

[11] Patent Number: 4,665,390

[45] Date of Patent: May 12, 1987

[54] FIRE SENSOR STATISTICAL DISCRIMINATOR

[75] Inventors: Mark T. Kern, Goleta; Kenneth A. Shamordola, Santa Barbara, both of Calif.

[73] Assignee: Hughes Aircraft Company, Los Angeles, Calif.

[21] Appl. No.: 768,539

[22] Filed: Aug. 22, 1985

[51] Int. Cl.[4] ..... G08B 17/00

[52] U.S. Cl. ..... 340/587; 340/578; 364/551; 364/554

[58] Field of Search ..... 340/587, 578; 364/551, 364/550, 554

[56] References Cited

U.S. PATENT DOCUMENTS 4,414,542 11/1983 Farquhar et al. ..... 340/587
4,472,715 9/1984 Kern et al. ..... 340/587
4,533,834 8/1985 McCormack ..... 340/578
4,570,157 2/1986 Kodaira ..... 340/587

*Primary Examiner*—Glen R. Swann, III
*Attorney, Agent, or Firm*—Ronald L. Taylor; A. W. Karambelas

[57] ABSTRACT

Circuitry for using the statistical properties of detected radiation in the time domain to discriminate between stimuli from fire and non-fire sources. Statistical discriminators for fire sensing may be combined with other types of sensors operating in the frequency domain for developing improved sensitivity with better security against false alarms. Such other types of sensors may include peak detectors, zero crossing detectors, second derivative-equal-to-zero detectors, for example. The invention determines the mean or average, the variance or standard deviation, the mean deviation, and the Kurtosis of sampled data in statistical analysis to discriminate between fires and non-fires.

47 Claims, 19 Drawing Figures

FIRE SENSOR STATISTICAL DISCRIMINATOR

BACKGROUND OF THE INVENTION 1. Field of the Invention

This invention relates to fire sensing systems and, more particularly, to methods for analyzing radiation detection signals developed by such systems to discriminate between stimuli from fire and non-fire sources.

2. Description of the Related Art

Sensing the presence of a fire by means of photoelectric transducers is a relatively simple task. This becomes more difficult, however, when one must discriminate reliably between stimuli from a natural fire and other heat or light stimuli from a non-fire source. Radiation from the sun, ultraviolet lighting, welders, incandescent sources and the like often present particular problems with respect to false alarms generated in fire sensing systems.

It has been found that improved discrimination can be developed by limiting the spectral response of the photodetectors employed in the system. Pluralities of signal channels having different spectral response bands have been employed in a number of prior art systems which utilize different approaches to solving the problem of developing suitable sensitivity for fire sensing while reliably discriminating against non-fire stimuli. The disclosed solutions, however, have not generally realized the degree of effectiveness which is required for a successful and reliable fire sensing system that is not unduly subject to generating false alarms.

The Cinzori U.S. Pat. No. 3,931,521 discloses a dual-channel fire and explosion detection system which uses a long wavelength radiant energy responsive detection channel and a short wavelength radiant energy responsive channel and imposes a condition of coincident signal detection in order to eliminate the possibility of false triggering. Cinzori et al U.S. Pat. No. 3,825,754 adds to the aforementioned patent disclosure the feature of discriminating between large explosive fires on the one hand and high energy flashes/explosions which cause no fire on the other. However, this specialized system is not readily convertible to more general fire sensor system applications, such as the present invention.

U.S. Pat. No. 4,296,324 of Kern and Cinzori discloses a dual spectrum infrared fire sensing system in which a long wavelength channel is responsive to radiant energy in a spectral band greater than about 4 microns and a short wavelength channel is responsive to radiant energy in a spectral band less than about 3.5 microns, with at least one of the channels responsive to an atmospheric absorption wavelength which is associated with at least one combustion product of the fire or explosion to be detected.

McMenamin, in U.S. Pat. No. 3,665,440, discloses a fire detector utilizing ultraviolet and infrared detectors and a logic system whereby an ultraviolet detection signal is used to suppress the output signal from the infrared detector. Additionally, filters are provided in series with both detectors to respond to fire flicker frequencies of approximately 10 Hz. As a result, an alarm signal is developed only if flickering infrared radiation is present. A threshold circuit is also included to block out low level infrared signals, as from a match or cigarette lighter, and a delay circuit is incorporated to prevent spurious signals of short duration from setting off the alarm. However, such a system may be confused by other flickering sources as simple and common as sunlight reflected off a shimmering lake surface or a rotating fan chopping sunlight or light from an incandescent lamp.

Muller, in U.S. Pat. Nos. 3,739,365 and 3,940,753, discloses dual channel detection systems utilizing photoelectric sensors respectively responsive to different spectral ranges of incident radiation, the signals from which are filtered for detection of flicker within a frequency range of approximately 5 to 25 Hz. A difference amplifier generates an alarm signal in one of these systems when the signals in the respective channels differ by more than a predetermined amount from a selected value or range of values. In the other system, the output signals from the difference amplifier are applied to a phase comparator with threshold circuitry and time delay. An alarm signal is provided only if the input signals are in phase, of amplitude in excess of the threshold level, and of sufficient duration to exceed the preset delay. However, such a system may be ineffective in discriminating against non-fires, such as a jet engine exhaust (which has a flicker content), in the presence of scintillating or cloud-modulated sunlight.

The Paine U.S. Pat. No. 3,609,364 utilizes multiple channels specifically for detecting hydrogen fires on board a high altitude rocket with particular attention directed to discriminating against solar radiation and rocket engine plume radiation.

The Muggli U.S. Pat. No. 4,249,168 utilizes dual channels respectively responsive to wavelengths in the range of 4.1 to 4.8 microns and 1.5 to 3 microns. Signals in both channels are subjected to a bandpass filter with a transmission range between 4 and 15 Hz for flame flicker frequency response. Both channels are connected to an AND gate so that coincidence of detection in both channels is required for a fire alarm signal to be developed.

The Bright U.S. Pat. No. 4,220,857 discloses an optical flame and explosion detection system having first and second channels respectively responsive to different combustion products. Each channel has a narrow band filter to limit spectral response. Level detectors in each channel signal detected radiation in excess of selected threshold levels. A ratio detector provides an output when the ratio of signals in the two channels exceeds a certain threshold. When all three thresholds are exceeded by detected radiation, a fire signal is produced.

Other fire alarm or fire detection systems are disclosed in MacDonald U.S. Pat. No. 3,995,221, Schapira et al U.S. Pat. No. 4,206,454, Steel et al U.S. Pat. No. 3,122,638, Krueger U.S. Pat. Nos. 2,722,677 and 2,762,033, Lennington U.S. Pat. No. 4,101,767, Tar U.S. Pat. No. 4,280,058, and Nakauchi U.S. Pat. Nos. 4,160,163 and 4,160,164.

Despite the abundance of systems in the prior art for fire detection, the fact remains that no system has proved to be fully effective in discriminating against false alarms. In those systems where sensitivity is enhanced, there appears to be a concomitant degradation in other performance parameters, such as false alarm immunity. The present invention is directed to techniques for analyzing radiation detection data to improve the reliability of fire detection.

SUMMARY OF THE INVENTION

Under certain circumstances, man-originated phenomena or occasional natural phenomena can duplicate the characteristics of a fire in the frequency domain. For example, the radiation from a light bulb (or other non-fire source emitting both light and heat) can appear to a detector as fire in the frequency domain if the light is chopped at a constantly varying rate. Sunlight reflecting off ripples on a body of water can develop the same effect. The prior art fire detection systems which are presently known utilize the frequency domain analysis approach for fire detection. The present invention involves processing amplitude information from each separate detection channel statistically in the time domain to eliminate the possibility of confusion and error from radiation detection in the frequency domain. The invention employs particular statistical methods in order to achieve this result.

The basic technique involves modelling a fire as a random process and applying selected statistical mechanisms to test for the characteristics of random processes. As a parameter to use to represent the "randomness" of a fire, amplitude distribution of the peak or change-in-slope point of the time domain signal is selected. Other parameters could be used also, such as zero crossing time interval, second derivative-equal-to-zero point, etc. Thus, in order to develop the data for the application of time domain statistical methods, one is required to keep a running tabulation of the peaks of the detected radiation signals. This is done by sampling the signal at the change-in-slope points. When the first derivative of the signal waveform changes sign, a sample is taken. In one particular embodiment of the invention, these sample signals over the last five seconds are stored in microprocessor memory locations. Approximately 40 to 50 data points, if developed in less than five seconds, are sufficient for the analysis. During the storage in memory, data points from more than five seconds previous are discarded. Periodically (approximately once per second) a computation is made using the data points stored in memory.

Once a collection of data points is stored in memory, various statistical mechanisms can be used to determine whether or not the distribution of data points matches known random processes. One parameter that has proven to be very definite of the randomness of fire versus the non-randomness of periodic radiation sources is the parameter of Kurtosis. Kurtosis is a measure of how the collection of data is concentrated about its mean. Large values of Kurtosis represent distributions with data points widely scattered from the mean.

To determine the mean, the variance (or standard deviation which is $\sqrt{\mu_2}$) and the Kurtosis, if $x_i$ represents the various data points, i=1, . . . N, then:

$$\text{mean} = \bar{x} = \frac{\sum_{1}^{N} x_i}{N}$$

$$\text{variance} = \mu_2 = \frac{\sum_{1}^{N} (x_i - \bar{x})^2}{N}$$

$$\text{Kurtosis} = \frac{\sum_{1}^{N} (x_i - \bar{x})^4}{(\mu_2)^2 \times N} = \frac{\mu_4}{(\mu_2)^2}$$

Kurtosis is defined as the ratio of the fourth central moment to the square of the second central moment:

$$K = \frac{\mu_4}{(\mu_2)^2}$$

where the fourth central moment is the average of all deviations raised to the fourth power, and the second central moment is the average of all deviations raised to the second power. As will be shown later, Kurtosis is quite different for fires and non-fires. However, the squaring and fourth power apparatus take a lot of computational time in a microprocessor embodiment and a simplified version would be desirable for use with small microprocessors.

Just as several definitions exist for expressing the most likely value which a statistically varying parameter may have (mean, median, mode, etc.), more than one definition exists for expressing the degree to which data points are dispersed about this "average" value. Each data point has a deviation, or difference, between its own value and that of the sample average, taken here to be the arithmetic mean. A popular parameter for expressing the overall deviation is the standard deviation ($\sigma$) which is the r.m.s. value of a series of deviations. For a series of N samples, $x_1$ through $X_N$, the mean ($\bar{x}$) is given by definition:

$$\bar{x} = 1/N \sum_{i=1}^{N} x_i$$

and the standard deviation by:

$$\sigma = \sqrt{\frac{\sum_{i=1}^{N} (x_i - \bar{x})^2}{N}}$$

This is a useful definition because the squares of the deviations result in positive components such that deviations of opposite polarity won't cancel. Also, the square function may be easily treated by algebra.

Another definition replaces the square term with that of absolute value, and thereby retains a positive contribution from each deviation. This is known as the mean deviation:

$$\bar{D} = 1/N \sum_{i=1}^{N} |x_i - \bar{x}|$$

It is less popular than the standard deviation because the absolute value function, defined as always giving a positive result:

$|x| = x$ for $x \geqq 0$ $|x| = -x$ for $x < 0$ is sometimes rather awkward to handle in algebraic manipulations. However, it has strong appeal for microprocessor applications because the polarity reversal in binary notation (complement and add 1 LSB) is much easier to implement than the squaring and square root functions.

Having defined a measurement for the deviation of the data about the mean, it is desirable to define a similar characteristic to express the extent to which the individual deviations are dispersed about the mean deviation. Two contrasting signals illustrate the need for this: a wideband Gaussian noise source and a square wave having a zero-to-peak value equal to the mean deviation or the standard deviation of the noise source. These have identical mean deviations yet shown radically different time characteristics and probability distribution functions (PDF) because the square wave has all of its data points clustered at the same deviation.

For the special case of a square wave, all deviations are equal and the Kurtosis takes on a value of 1. As deviations become increasingly dispersed, those greater than $\sigma$ contribute more to $\mu_4$ than those less than $\sigma$ subtract from $\mu_4$. This is due to the non-linearity from the fourth power implicit in $\mu_4$. The $\mu_2^2$ in the denominator may be thought of as a normalization factor which causes K to be without units and independent from the actual value of $\mu_2$ or $\sigma$.

Another means of evaluating the dispersion of data around its standard deviation (or mean deviation, whichever has been selected) is to find the mean "deviation about the deviation" i.e., the average amount by which each individual deviation differs from the mean (or standard) deviation. Again, the absolute difference will be used in order to preserve a positive contribution from each sample. With each individual deviation given by $|x_i - \bar{x}|$ as before, the mean difference between individual deviations and the mean deviation (hereafter defined by the term "spread" for lack of a better one) can be expressed as:

$$\text{spread} = \bar{S} = 1/N \sum_{i=1}^{N} \left| |x_i - \bar{x}| - \bar{D} \right|$$

This may be normalized by dividing by $\bar{D}$ and will be called "modulation" as the parameter is now highly analogous to that of amplitude modulation of a carrier. An unmodulated carrier (even with varying frequency) has a spread, and hence modulation, of zero. The maximum possible steady state spread is equal to the mean deviation and hence modulation can vary from zero to unity, or 100%.

The preceding definition of modulation is intended to permit the evaluation of a signal for the same quality that Kurtosis provides, but without the need for multiplication (squaring and fourth powers) or extracting square roots. If mean deviation is used for $\bar{D}$, an integer power of 2 used for N, and a constant fixed degree of modulation used for a decision criterion, no true divisions need be performed. The apparent division by N becomes a series of right shifts (performed before summing to avoid overflow). The threshold test becomesa comparison between spread and a fixed fraction of $\bar{D}$, again obtained by right shifting (and possibly adding to get the desired fraction). A division will be performed only if an analog measure of modulation is desired for investigation purposes. Thus, implementation of this "simplified Kurtosis" makes possible the use of small inexpensive microprocessors to perform the real-time tasks of a fire sensor statistical discriminator.

To make the data collection practical in accordance with the present invention, an arrangement for reading in data from the detected radiation signals includes a hysteresis circuit. The effect of this hysteresis circuit is to "clean up" the data to separate the primary information from small perturbations or noise that may be present. The hysteresis circuit generates an output signal that follows behind the input signal by a fixed offset until a slope reversal occurs and a dead zone has been crossed. At that time, the output begins tracking the input with a lagging offset of the opposite polarity. This assures that small signal swings of less than one to three percent of full scale do not give rise to a new sampling by the following peak detector. The slope reversal indication in the output are stored in a peak detector. Real time signal deviations are obtained by comparing the output signals for maximum and minimum sampling with the sample means. Comparing these results with the mean deviation followed by smoothing, again by a first order lag gives a value of spread which will lie between zero and value equal to the mean deviation. By dividing with an analog divider, the modulation ratio S/D becomes available and may be compared to a fixed reference threshold. The final binary output is then a logic TRUE whenever the modulation is adequate to be that of a flicker signal, indicating fire sensing.

Another parameter that can be used to judge whether the set of data points in memory is randomly distributed is the output of a simple up-down counter. If this counter is programmed to count down at, for example, a 3 Hz rate and count up at the rate data is received from the waveform peaks, then low frequency waveforms will not exceed a predetermined count threshold, regardless of whether or not they are random. Since the waveform from a fire is known to have higher frequency components, this up-down counter parameter represents a small, but futher, criterion for separating fires from non-fires.

Another parameter that can be used to judge randomness involves what is known as the Chi-Square Test for "goodness-of-fit". In statistics, if one can say with a 95% confidence level that a given result could not have happened by chance, the result is said to be statistically "significant". Similarly, a 99% confidence level is "highly significant".

Applying the Chi-Square Test to the collection of data points in memory, with the 95% confidence level, one can say that the given data points are normally distributed to a "significant" degree if the Chi-Square Test shows positive. The Chi-Square Test is a judge of how close to a random distribution the data points represent. The Chi-Square Test thus works well together with the Kurtosis parameter to further exclude non-fire waveforms. For example, a waveform with a few large, narrow peaks, but most of its information concentrated near zero, could have a large Kurtosis due to the fourth power effect of the large peaks. However, the Chi-Square Test would recognize that the data points are not randomly distributed.

On the other hand, a periodic signal could have its amplitude modulated in a psuedo-random fashion to the point where a collection of data points may be able to pass a Chi-Square Test. This might be the case especially if the Chi-Square Test did not have many data points to work with and if the data points were clustered somewhat about the mean. The Kurtosis parameter, however, will detect that the "randomness" is clustered about the mean, even with ten or fewer data points, and thus fills in the gap of the Chi-Square Test where few data points are available.

BRIEF DESCRIPTION OF THE DRAWINGS

A better understanding of the present invention may be had from a consideration of the following detailed description, taken in conjunction with the accompanying drawing in which.

DESCRIPTION OF THE PREFERERD EMBODIMENTS

Figure 1:
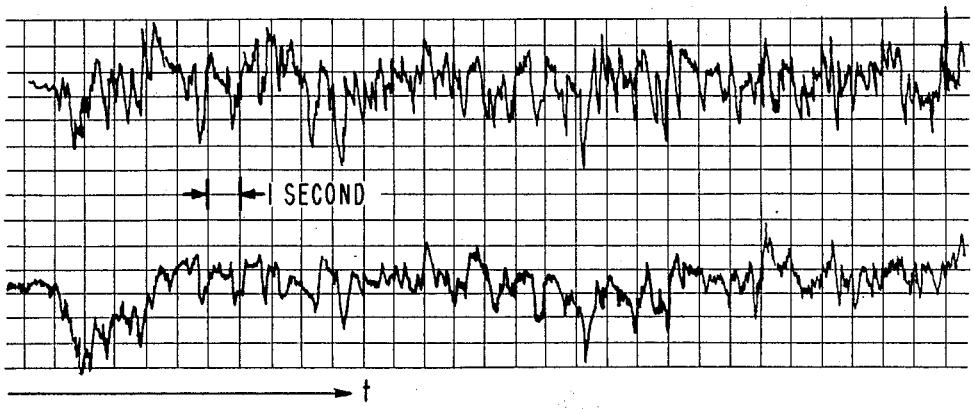
FIG. 1 is a time domain plot of waveforms from a flickering fire in both long and short wavelength channels.
Figure 2:
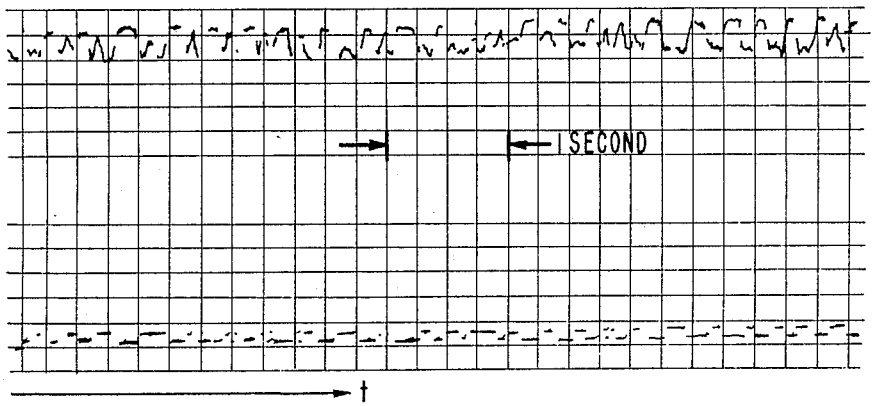
FIG. 2 is a time domain plot of comparable waveforms of a hot, dim lightbulb that is randomly chopped.

FIGS. 1 and 2 are time domain plots of detected radiation and are presented to show the differences in detected radiation between a flickering fire and an artificial source. FIG. 1 shows a time domain plot of detected radiation from a flickering fire. The waveforms in FIG. 1 represent detection in two channels. The upper waveform illustrates the signal from a short wavelength detector having a response in the range of 0.8–1.1 microns. The lower waveform shows the output of a long wavelength detector having a response in the range of 7–25 microns. Correlation on a time basis between the upper and lower waveforms is apparent. The amplitude of a given waveform is quasi-random.

FIG. 2 shows the time domain plot of detected radiation from a hot, dim lightbulb that is randomly chopped. The time scale is expanded, relative to FIG. 1, and the two waveforms are interchanged; that is, the lower waveform in FIG. 2 represents the output of a short wavelength detector in the range of 0.8–1.1 microns while the upper waveform represents the output of a long wavelength detector, in the range of 7–25 microns.

Figure 3:
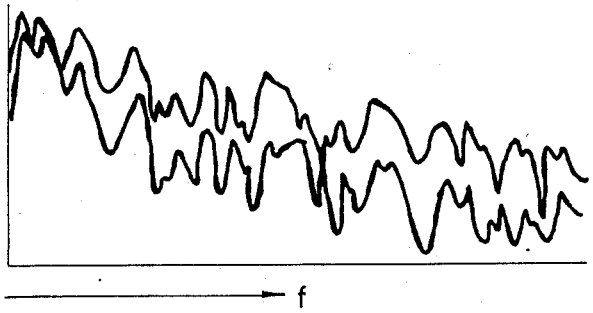
FIG. 3 is a graph of waveforms of detected radiation from a flickering fire in the frequency domain.

FIG. 3 represents the plots of detected radiation from a flickering fire in the frequency domain from zero to 25 Hz. The upper waveform represents the shorter wavelength radiation while the lower waveform represents the longer wavelength radiation. The time span for collecting this data is ten seconds and it will be noted that the peaks and valleys change from time to time. The general outline, however, is rolling off at the higher frequencies.

Figure 4:
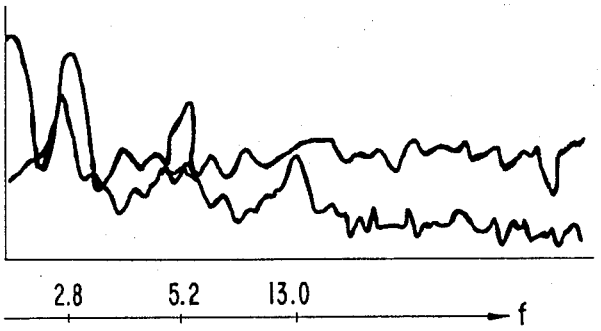
FIG. 4 is another frequency domain plot of detected radiation from a hot, dim lightbulb chopped at a fixed frequency.

FIG. 4 shows the waveforms of detected radiation from a hot, dim lightbulb which is chopped at 2.6 Hz. The longer wavelength waveform is the upper waveform in the right-hand portion of the figure. There are clear peaks at 2.6 Hz, 7.8 Hz, and 13 Hz, corresponding to odd harmonics of the chopping frequency.

Figure 5:
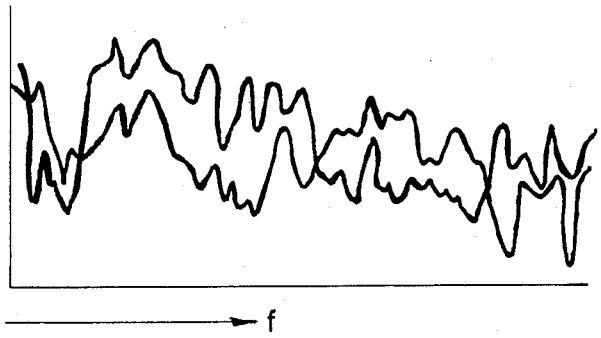
FIG. 5 is a plot corresponding to that of FIG. 4 but with the radiation chopped at random.

FIG. 5 shows plots of detected radiation from a hot, dim lightbulb, as in FIG. 4, except that the chopping of the radiation is random rather than at a fixed frequency. The longer wavelength waveform is the upper waveform in the left half of the figure. No clear peaks are present and the frequency domain plot resembles very much that of FIG. 3.

FIGS. 2 to 5 show that operation in the frequency domain over the ten second sample integral does not provide sufficient information to allow one to distinguish between a fire and a light bulb that is randomly chopped. Time domain processing is required.

Since a chopped waveform has relatively equal positive and negative peaks, peak detection was used in developing the data to be processed. In mechanzing the processing an Intel 2920 signal processor was chosen. Because of the limited math capability of the 2920, the true Kurtosis calculation of $\mu_4/\mu_2^2$ was not possible at 100 samples per second. Thus the approximation to true Kurtosis (called "modulation") was used for the first embodiment. This approximation proved quite successful in separting the random fire signal of FIGS. 1 and 3 from the chopped light bulb radiation of FIGS. 2, 4 and 5.

Figure 6:
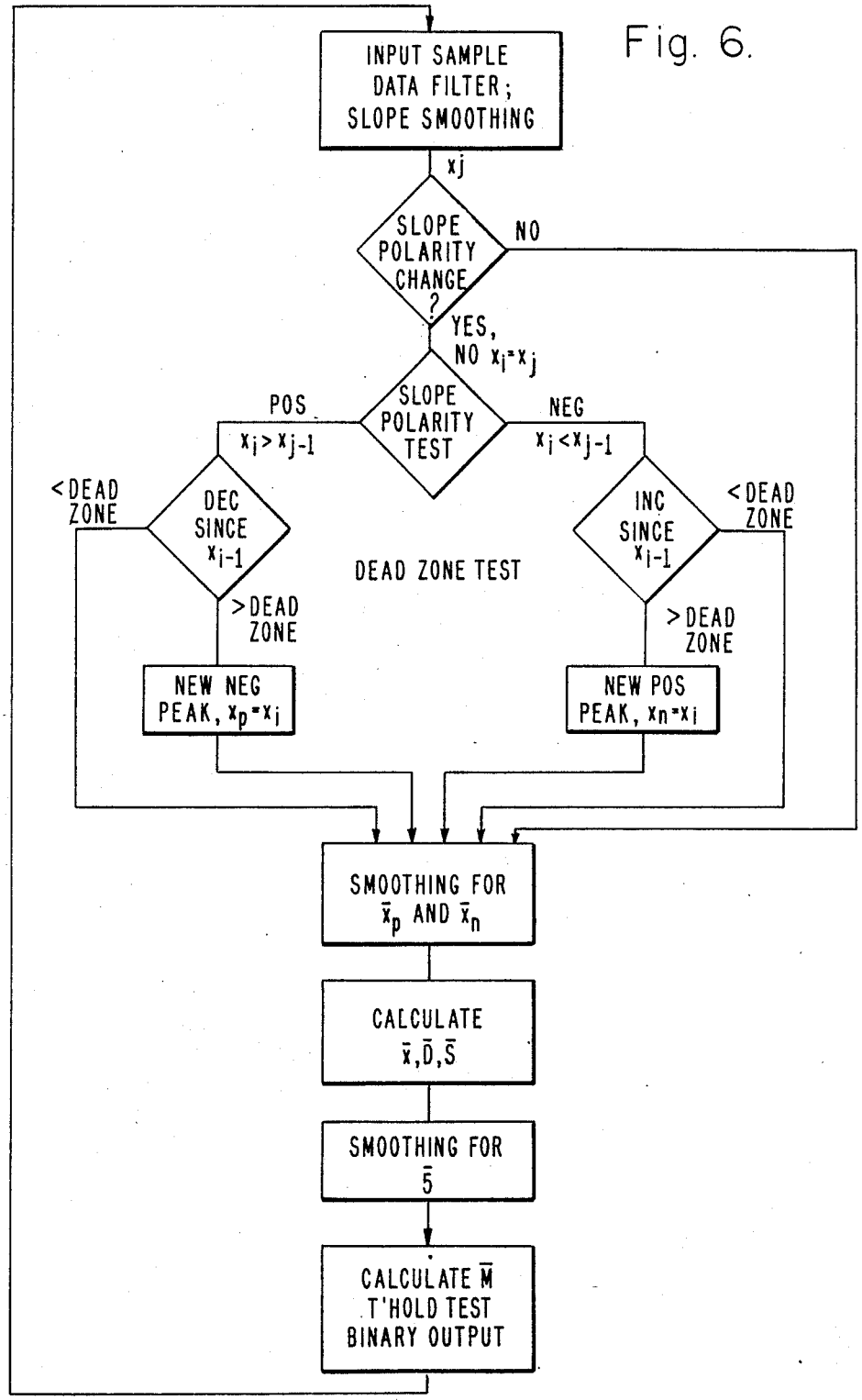
FIG. 6 is a flow chart illustrating a typical program utilizing one particular arrangement of the present invention.

A flow diagram is depicted in FIG. 6 representing a typical program which may be employed for performing the modulation test described hereinabove, wherein the spread $\bar{S}$ is determined from the equation:

$$\bar{S} = 1/N \sum_{i=1}^{N} |x_i - \bar{x}| - \bar{D}|$$

which is then normalized by dividing by $\bar{D}$ to develop modulation. The particular program represented in FIG. 6 has been implemented on an Intel 2920 signal processor using a 100 sample/second input rate, a five second smoothing time constant, and a modulation threshold of 38% for the decision as to whether the input signal corresponds to chopped or random radiation.

The incoming data samples, taken every 0.01 seconds, are passed through a 3 pole 4 Hz low pass filter implemented by recursive digital filter techniques. The filter closely resembles a Gaussian configuration, but has slightly higher damping of the conjugate pole pair to insure lack of overshoots from rapid input changes. In addition, the slope polarity is taken from the difference between output samples separated by four sample intervals in order to further reduce the disturbance from noise transients above the desired signal passband.

The slope polarity is used to determine when a filtered data sample may be retained as a new positive peak ($x_p$) or negative peak ($x_n$). To be retained, it must occur after a signal change of at least 1% of full scale since the previous peak. This dead zone reduces the probabilility that minor fluctuations will degrade the usefulness of the peak data. Positive and negative peak values are independently smoothed by a 2.5 second time constant, single pole filter as an approximation to true averages, $\bar{x}_p$ and $\bar{x}_n$.

From these two values the sample mean, $\bar{x}$, is estimated as $\frac{1}{2}(\bar{x}^p+\bar{x}^n)$ and the mean deviation is estimated as $\bar{D}=\frac{1}{2}(\bar{x}_p-\bar{x}_n)$. With these, each peak sample, $x^p$ or $x^n$, provides an individual deviation $x_i-\bar{x}$ which may be used to calculate the spread and modulation as previously described. The smoothing time constant applied to $\overline{S}$ and $\overline{M}$ is 5 seconds. It must be longer than that used to derive $\overline{x}$ and $\overline{D}$ so that under transient conditions $\overline{S}$ cannot exceed $\overline{D}$, giving rise to $\overline{M}$ negative or greater than one. In the threshold test, if $\overline{M} > \frac{3}{8}\overline{D}$, modulation is considered sufficient to indicate fire flicker signal.

It should be noted that in this embodiment the lack of second and fourth powers of the input signal avoids the dynamic range problems associated with a true implementation of the Kurtosis function. For example, an input signal range of 30:1 is typical of a useful range of 3 ft. to 100 ft. wtih 30 dB of AGC compensation. Taken to the fourth power, this requires a dynamic range of 810,000:1, or 118 dB plus another 10 to 20 dB for waveform resolution within the weakest possible signal. Clearly, this requires a microprocessor with considerably more arithmetic capability than the 2920 for a fire sensor application. The modulation approximation requires only the dynamic range of the signal plus the added 10 to 20 dB for waveform resolution, a total of 40 to 50 dB.

Figure 7:
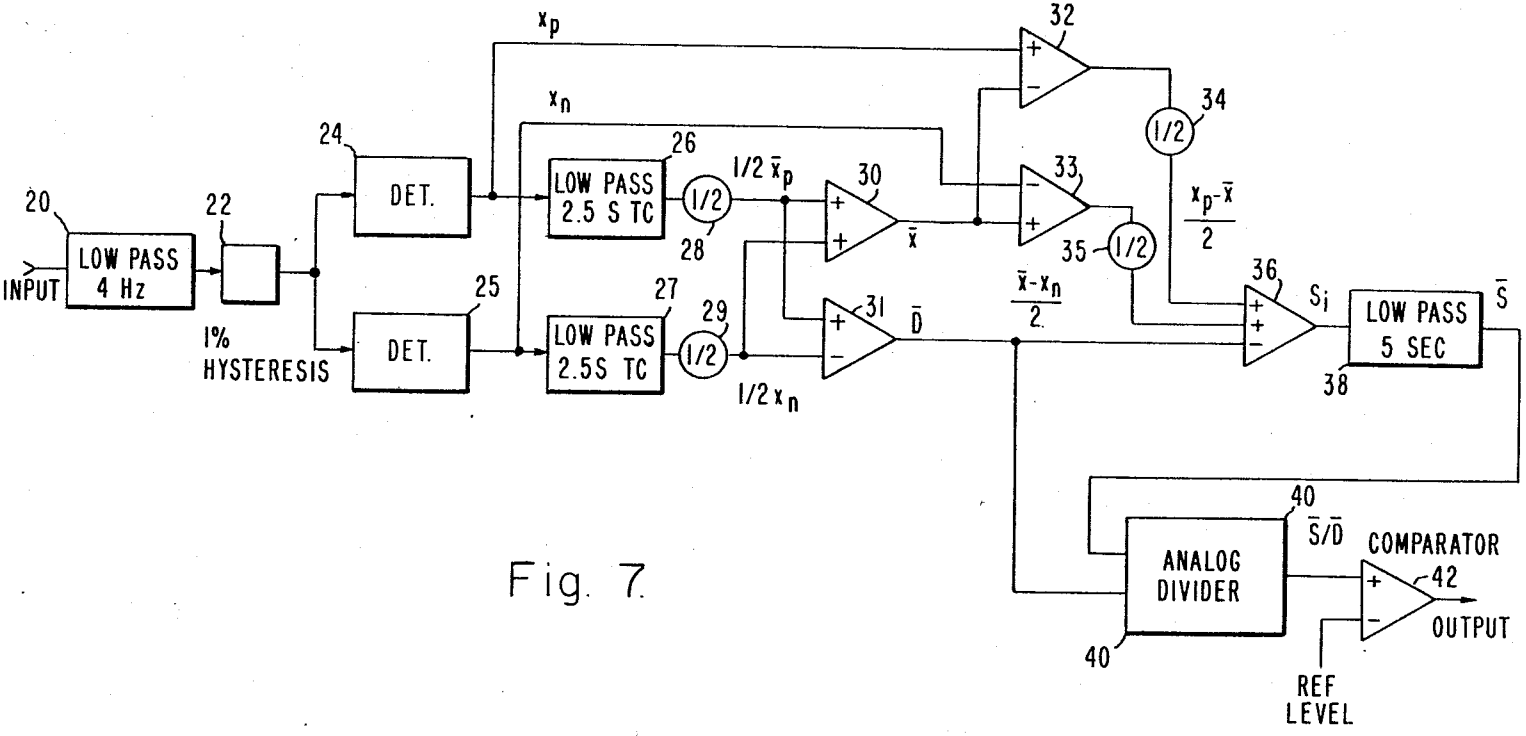
FIG. 7 is a functional block diagram repesenting another particular arrangement in accordance with the present invention.

The functional block diagram of FIG. 7 represents another possible implementation of a modulation detector for the approximation of Kurtosis. This is shown comprising an input stage having a lowpass filter 20 with a cutoff frequency of 4 Hz. This is followed by a hysteresis circuit 22 out of which the signal is split into positive and negative portions for application to respective peak detectors 24, 25. Each of the detectors is coupled to a corresponding lowpass filter 26 or 27 having a time constant of 2.5 seconds. These lowpass filters 26, 27 perform a summing operation on $x_p$ and $x_n$ in analog form rather than in digital form, such as summing $x_i$ for the purpose of computing an average, as follows:

$$\bar{x} = \frac{\sum_{i=1}^{N} x_i}{N}$$

These are in turn, in their respective channels, coupled to attenuators 28 or 29 and operational amplifiers 30, 31. The output of the amplifier 30 is applied to another pair of operational amplifiers 32, 33 which are coupled to receive respectively, on the remaining inputs, signals from the outputs of the peak detectors 24, 25. Attenuator stages 34, 35 are coupled respectively to the outputs of the amplifiers 32, 33 and are connected to provide inputs to a summing amplifier 36 which is also coupled to the output of the amplifier 31. The output of the amplifier 36 is coupled to a lowpass filter 38 having a five second time constant which in turn is coupled to an analog divider 40 which receives a second input from the output of the amplifier 31. A comparator 42 is coupled to the output of the divider 40 and also has a reference level input.

In one preferred arrangement in accordance with the invention, the detectors 24, 25 are peak detectors which respond to a change of slope of the input waveform. As alternatives, the blocks 24, 25 may represent zero crossing detectors, for determining zero crossing time intervals, or second derivative-equal-to-zero detectors, for example. Such detectors 24, 25 develop data in the form of selected sample signals which are then processed for analyzing the input waveform in accordance with the invention. In the specific discussion of the embodiments of FIGS. 7 and 7A, the circuits will be described in the context of peak detectors 24, 25; however, it will be understood that these detectors 24, 25 may as well be the other types mentioned.

In the circuit of FIG. 7, the input signal is filtered to below 4 Hz in order to remove high frequency noise and is then applied to the hysteresis circuit 22. This stage, which may be fabricated with an assortment of integrators, diodes and offsets, as known in the art, generates an output which follows behind the input by a fixed offset until a slope reversal occurs and a dead zone has been crossed. At that time, the output begins tracking the input with a lagging offset of the opposite polarity. This assures that small signal swings of less than one to three percent of full scale do not give rise to a new sampling by the following peak detector. Each time a slope reversal occurs after a swing of greater than 1%, referenced to the previous slope reversal, the new peak value (positive or negative) is stored in a peak detector. The resulting staircase-like waveforms are independently smoothed with a first order lag filter having a time constant of 2.5 seconds. The following circles 28, 29, summing amplifier 30 and difference amplifier 31 combine one-half the sum of $\bar{x}_p$ and $\bar{x}_n$ to get the average and also one-half the difference to get the mid-to-peak swing, or mean deviation. The staircase values from maximum and minimum samples ($x_p$ and $x_n$) are compared to the sample mean to obtain real time deviations. Comparing these to the mean deviation and smoothing, again by first order lag, gives a value of spread $\overline{S}$ which will lie between zero and a value equal to mean deviation. By dividing with an analog divider 40, the modulation ratio, $\overline{SD}$, becomes available and may be compared to a fixed reference threshold in the comparator 42. The binary output is then a logic TRUE whenever the modulation is adequate to be that of a flicker signal.

The equations for $\overline{S}$ and $\overline{D}$ given earlier were implemented as shown in FIGS. 6 and 7 to adapt to the strengths of the 2920 signal processor. Thus, low pass filters were used instead of calculated averages such as $$\bar{x} = 1/N \sum_{i}^{N} x_i$$

$$\overline{D} = 1/N \sum_{i}^{N} |x_i - \bar{x}|$$

in order to avoid storing N data points. For other microprocessors having larger memories, a straight calculation based on the equations directly may be employed.

Figure 7A:
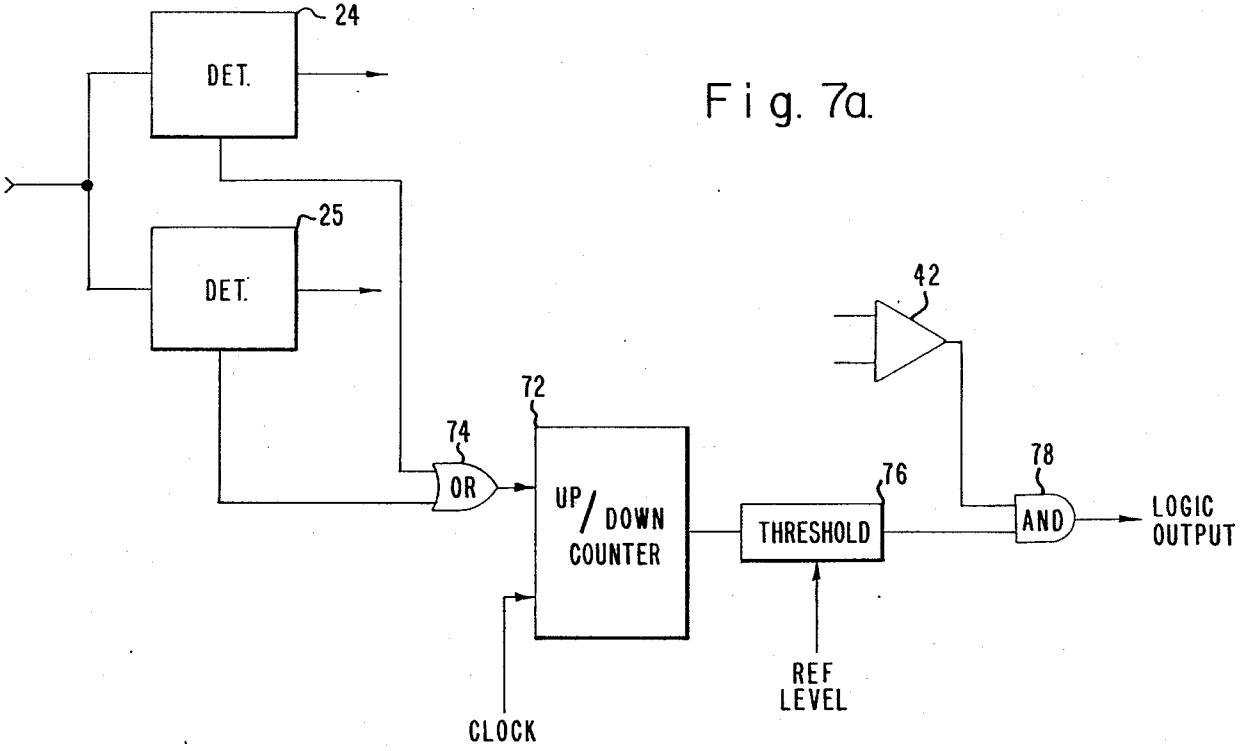
FIG. 7A is a block diagram depicting a particular arrangement which may be implemented as an adjunct to FIG. 7.

FIG. 7A is a block diagram representing a particular circuit in accordance with one feature of the present invention which may be incorporated as an adjunct to the circuit of FIG. 7. FIG. 7A depicts an up/down counter 72 which is driven in the UP direction by signals derived from the sampled waveform and in the DOWN direction by a clock. The circuit of FIG. 7A may be connected to the circuit of FIG. 7 in the manner indicated.

Signals to drive the counter 72 in the UP direction are taken from the positive and negative peak detectors 24, 25 of FIG. 7 before waveform smoothing is applied. These signals are applied to an OR gate 74 and then to the UP input of the counter 72. The DOWN input to the counter comes from a clock signal which is operating at approximately 3 Hz (for the circuit of FIG. 7 wherein the signals are cutoff above 4 Hz by the low pass filter 20). The count which is established in the counter 72 is applied to a threshold stage 76 having a preselected reference level input for signal comparison. The output of the threshold stage 76 is applied to an AND gate 78 which is connected to receive as a second input the output from the comparator stage 42 of FIG. 7. Only when both inputs to the AND gate 78 are TRUE will the logic output of the AND gate 78 be TRUE, thus signifying a fire.

With the counter 72 counting down at the clock rate of 3 Hz and counting up at the rate data is received from the waveform peaks of the peak detectors 24, 25, low frequency waveforms will not exceed the predetermined count threshold of the stage 76, regardless of whether or not they are random. When a waveform from a fire is detected, however, the higher frequency components of such a waveform cause the count to exceed the preset reference level of the threshold stage 76, thereby applying a TRUE signal to the AND gate 78.

Figure 8:
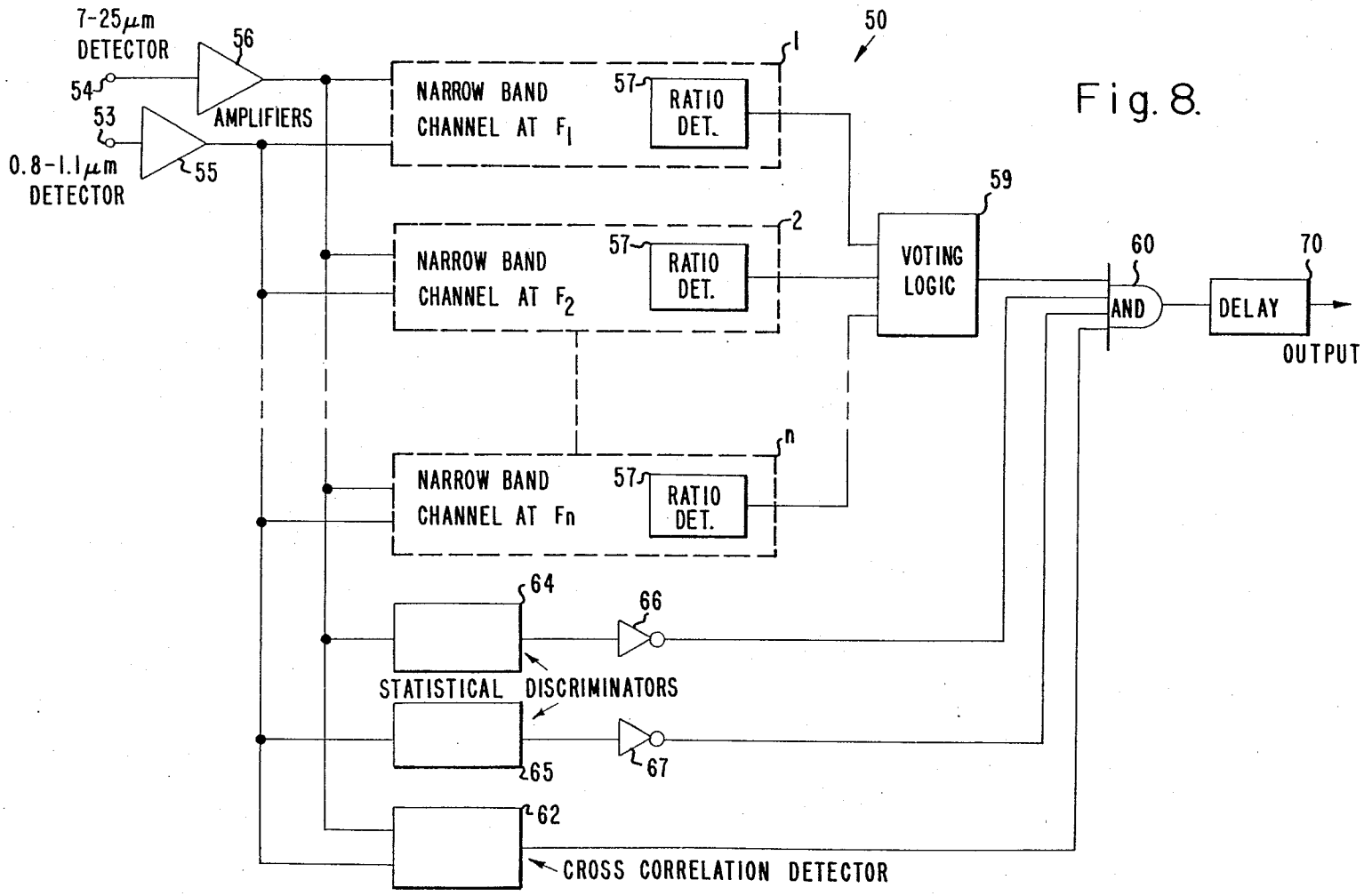
FIG. 8 is a block diagram illustrating use of the present invention in a dual spectrum frequency responding fire sensor of the cross correlator type.

FIG. 8 is a block diagram showing the implementation of statistical discriminators in accordance with the present invention in a dual spectrum frequency-responding fire sensor, such as is described in the co-pending application Ser. No. 592,611 of Mark T. Kern, entitled Dual Spectrum Frequency Responding Fire Sensor, assigned to the assignee of this application. The content of application Ser. No. 592,611 is incorporated here by reference as though specifically set forth herein. The circuit of FIG. 8 corresponds to FIG. 5 of application Ser. No. 592,611, with statistical discriminators of the present invention replacing the periodic signal detectors of that FIG. 5 and with the addition of a cross correlation detector such as is disclosed in FIG. 5 of our co-pending application Ser. No. 735,039 entitled Fire Sensor Cross-Correlator Circuit and Method, also assigned to the assignee of this application. The content of that application is also incorporated here by reference as though fully set forth herein.

In FIG. 8, a system 50 is shown having n dual narrow band channels 1, 2, . . . n, each set at a different narrow band filter spectral passband $F_1, F_2, \ldots F_n$. Each of the narrow band channels incorporates dual signal channels extending respectively from amplifier 55, coupled to the short wavelength detector 53, and amplifier 56, coupled to the long wavelength detector 54, to a ratio detector 57. As indicated, the short wavelength detector 53 responds to wavelengths in the range of 0.8 to 1.1 microns and the long wavelength detector 54 responds to wavelengths in the range of 7–25 microns. Alternatively, the short wavelength detector 53 may be set to respond to wavelengths in the range of 1.3 to 1.5 microns.

Each of the signal channels includes a narrow band filter, a full wave rectifier and a low pass filter connected in series between the amplifiers 55 or 56, as the case may be, and the input of the ratio detector stage 57. The outputs of the ratio detectors 57 of the n narrow band channels 1, 2 . . . n are applied to a voting logic stage 59 which generates an output signal which is either TRUE or FALSE in accordance with the majority of the ratio detector output signals from the n narrow band channels. This output is connected as one input to an AND gate 60, the other inputs of which are the output of a cross correlation detector 62 and outputs of a pair of statistical discriminators 64, 65, applied through inverter stages 66, 67. The output of the AND stage 61 is applied to a delay stage 70, which supplies the output of the sensor system 50.

The statistical discriminators 64, 65 of FIG. 8 correspond to the circuit shown in FIG. 7. These replace the periodic signal auto correlation detectors of our prior application and provide improved recognition of artificially chopped sources, thereby developing better security against false alarms. In the circuit of FIG. 8, an artificially chopped signal is recognized as such by the statistical discriminators 64, 65 thereby inhibiting the AND gate 60 to prevent the circuit from developing a TRUE signal as a false alarm at the output. The statistical discriminators of the present invention may be used in place of periodic signal detectors in other fire sensor apparatus to achieve a more restrictive response to artificially chopped radiation sources.

According to statistical theory, a truly random process will have a Kurtosis of 3.0. To see how some fire signals and some non-fire signals compared to a random process, some analysis was performed by calculating the Kurtosis of sections of recorded data.

Figure 9:
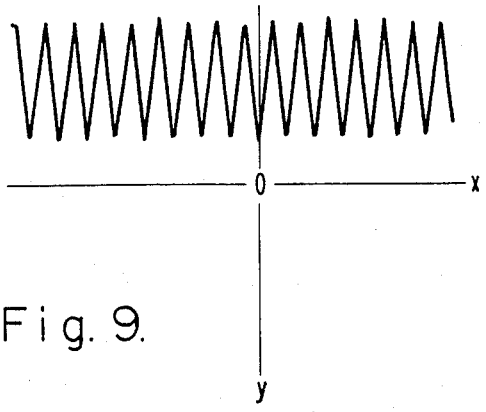
FIGS. 9–16 are plots illustrating various waveforms which are included to illustrate the application of the present invention.
Figure 14:
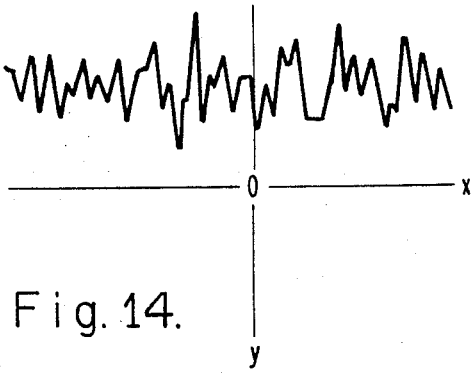
Figure 15:
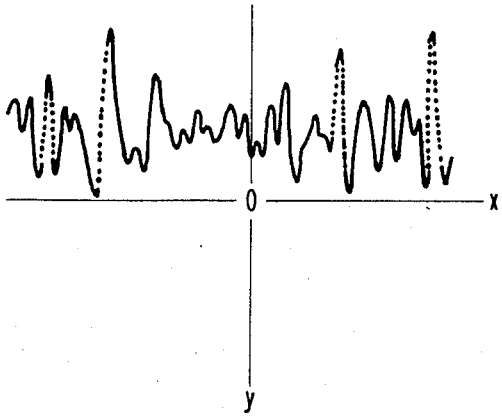
Figure 16:
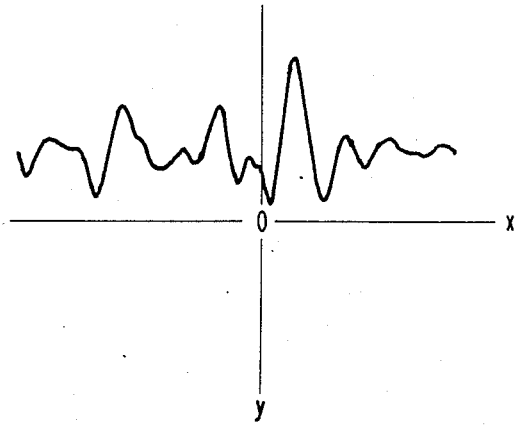

FIGS. 9–16 show various waveforms which illustrate this Kurtosis calculation performed in accordance with the present invention, based on selected real time signals. In these figures, the waveform of FIG. 9 is a pure sine wave, provided for comparison. The waveforms of FIGS. 10 and 11 correspond to radiation from a hot, dim lightbulb which is chopped. The chopping for the waveform of FIG. 10 varies in frequency. The waveform of FIG. 12 corresponds to sunlight radiation on a clear day. The waveforms of FIGS. 13, 14 and 15 correspond to radiation from fires at varying distances of 100 feet, 50 feet and 20 feet, respectively. Finally, the waveform of FIG. 16 is derived from sunlight on a partly cloudy day.

In these instances, the calculations are based on the true Kurtosis equation:

$$K = \mu_4/\mu_2$$

and not on the approximation of spread $\bar{S}$ derived by dividing by $\bar{D}$, as described above. Each calculation for the waveforms of FIGS. 9–16 represents 20 data points (10 positive, 10 negative). The data, in millivolts and after amplification, appear in the following Table 1, where some signals are amplified more than others in order to obtain adequate resolution.

Each of the signals in Table 1 and as respresented in the waveforms of FIGS. 9–16 is riding on a DC level of about 1 volt. This makes no difference, since data points have the average ($\bar{x}$) subtracted out in order to obtain the variance and the Kurtosis.

TABLE 1

Figure 10:
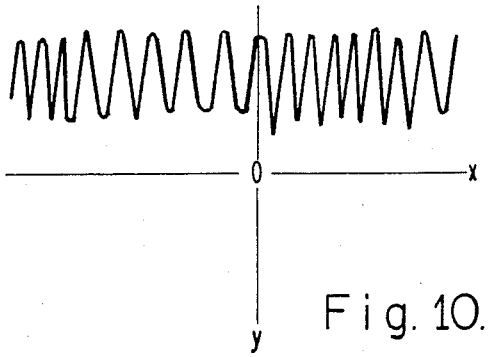
Figure 11:
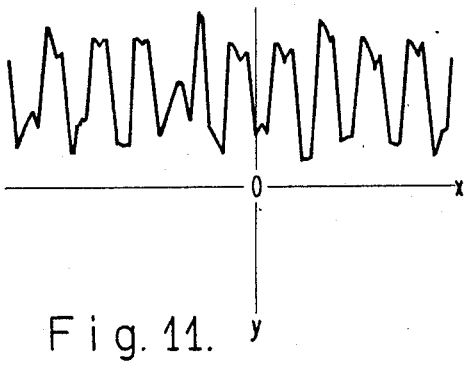
Figure 12:
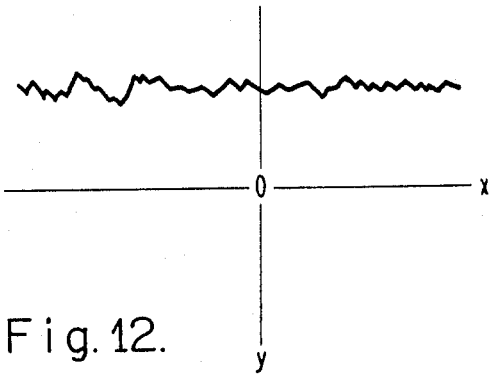
Figure 13:
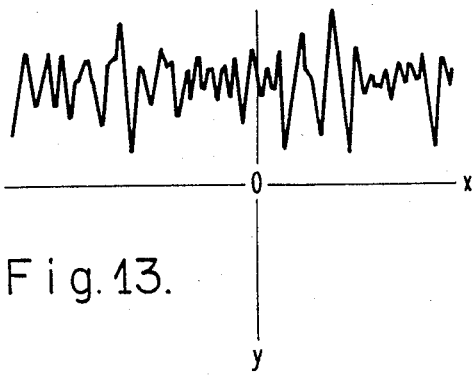

| Data Point # | FIG. 9 | FIG. 10 | FIG. 11 | FIG. 12 | FIG. 13 | FIG. 14 | FIG. 15 | FIG. 16 |
|---|---|---|---|---|---|---|---|---|
| 1 | 588 | 1607 | 1581 | 1077 | 1556 | 839 | 1494 | 645 |
| 2 | 1934 | 613 | 1646 | 1154 | 823 | 1217 | 301 | 897 |
| 3 | 588 | 1613 | 367 | 1114 | 1485 | 1133 | 1146 | 710 |
| 4 | 1934 | 695 | 741 | 1366 | 697 | 1486 | 861 | 1439 |
| 5 | 588 | 1638 | 706 | 1028 | 1944 | 1019 | 1096 | 462 |
| 6 | 1934 | 641 | 1756 | 1337 | 356 | 1346 | 45 | 782 |
| 7 | 588 | 1580 | 1690 | 1226 | 1428 | 1019 | 2047 | 159 |
| 8 | 1934 | 717 | 1759 | 1325 | 917 | 1480 | 441 | 2034 |
| 9 | 587 | 1545 | 433 | 1154 | 1547 | 748 | 667 | 287 |
| 10 | 1934 | 751 | 462 | 1200 | 1367 | 1721 | 313 | 1054 |
| 11 | 588 | 766 | 413 | 1092 | 1459 | 881 | 1540 | 649 |
| 12 | 1934 | 724 | 1750 | 1280 | 811 | 1227 | 637 | 1057 |
| 13 | 587 | 1602 | 1624 | 1104 | 1301 | 487 | 877 | 838 |
| 14 | 1935 | 716 | 1742 | 1283 | 945 | 2047 | 710 | 809 |
| 15 | 587 | 704 | 530 | 1172 | 1484 | 750 | 1122 | 946 |
| 16 | 1934 | 1596 | 1265 | 1228 | 1071 | 1304 | 861 | — |

TABLE 1-continued

| | | | | | | | | |
|---|---|---|---|---|---|---|---|---|
| 17 | 588 | 481 | 763 | 1122 | 1359 | 1090 | 897 | — |
| 18 | 1934 | 1609 | 2047 | 1266 | 956 | 1517 | 715 | — |
| 19 | 587 | 625 | 394 | 1050 | 1387 | 825 | 1172 | — |
| 20 | 1933 | 1625 | 1749 | 1195 | 965 | 1285 | 758 | — |

| Type Signal | Sine Have | Light Bulb | Light Bulb | Sun-light | Fire @ 100' | Fire @ 50' | Fire @ 20' | Sun-light |
|---|---|---|---|---|---|---|---|---|
| Ave | 1296 | 1112 | 1219 | 1201 | 1214 | 1204 | 894 | 888 |
| | 672 | 459 | 594 | 95 | 380 | 373 | 469 | 477 |
| K | 1.01 | 1.09 | 1.34 | 1.89 | 2.57 | 2.71 | 3.16 | 3.24 |
| $\chi^2$ | 43.0 | 21.9 | 22.0 | 2.6 | 7.2 | 0.8 | 3.5 | 3.5 |

As is evident in Table 1, the chopped waveforms of FIGS. 9–11, even though varying in frequency as in FIG. 10, have a Kurtosis very close to a pure sine wave (FIG. 9). On the other hand, the fires, even at a distance of 100 feet, have a radically different Kurtosis (K=2.5 to 3.2) and a value very close to that of a truly random process.

Sunlight signals, as shown in FIGS. 12 and 16, appear as random signals rather than chopped signals. The smaller sunlight signal of FIG. 12 has a Kurtosis that falls in the region between a fire and a chopped signal. On the other hand, the larger sunlight signal of FIG. 16 (a 15 point calculation rather than a 20 point calculation) has a Kurtosis similar to that of a fire. This is due to its random versus chopped nature. In a fire sensor system application, the high Kurtosis of cloud-modulated sunlight allows a fire to be detected by other mechanisms, such as those which are the subject of the two co-pending applications referenced hereinabove, even in the presence of direct sunlight.

Figure 17:
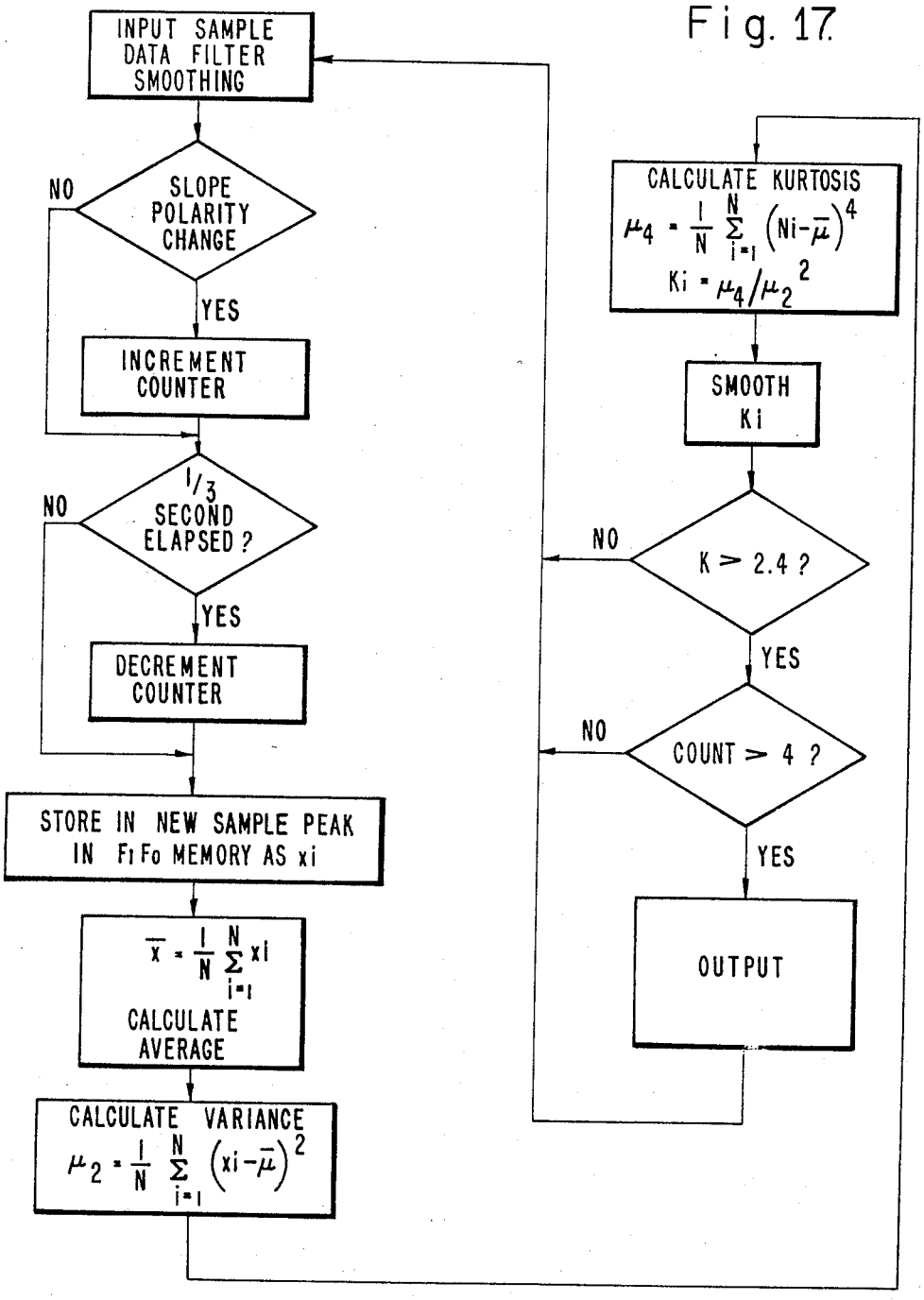
FIG. 17 is a flow chart illustrating a combined counter and Kurtosis test for fire detection.

The flow chart of FIG. 17 illustrates how the Kurtosis test is mechanized along with the up/down counter test (see FIG. 7A). A ⅓ second elapsed time decision box represents a 3 Hz counter 72 that counts down, while peak signals generated from slope polarity changes energize the counter to count up. A threshold of a count of 4 is used as the decision point as to whether data from slope changes is being received fast enough to represent a fire.

Similarly, a decision point of a Kurtosis of 2.4 is used to indicate whether the data points are distributed properly to indicate a fire. The 2.4 reference level is derived empirically from the variations of Kurtosis for a fire being in the range of 2.5 to 3.2 from Table 1, with that of non-fires being in the range of 1.0 to 1.9.

Figure 18:
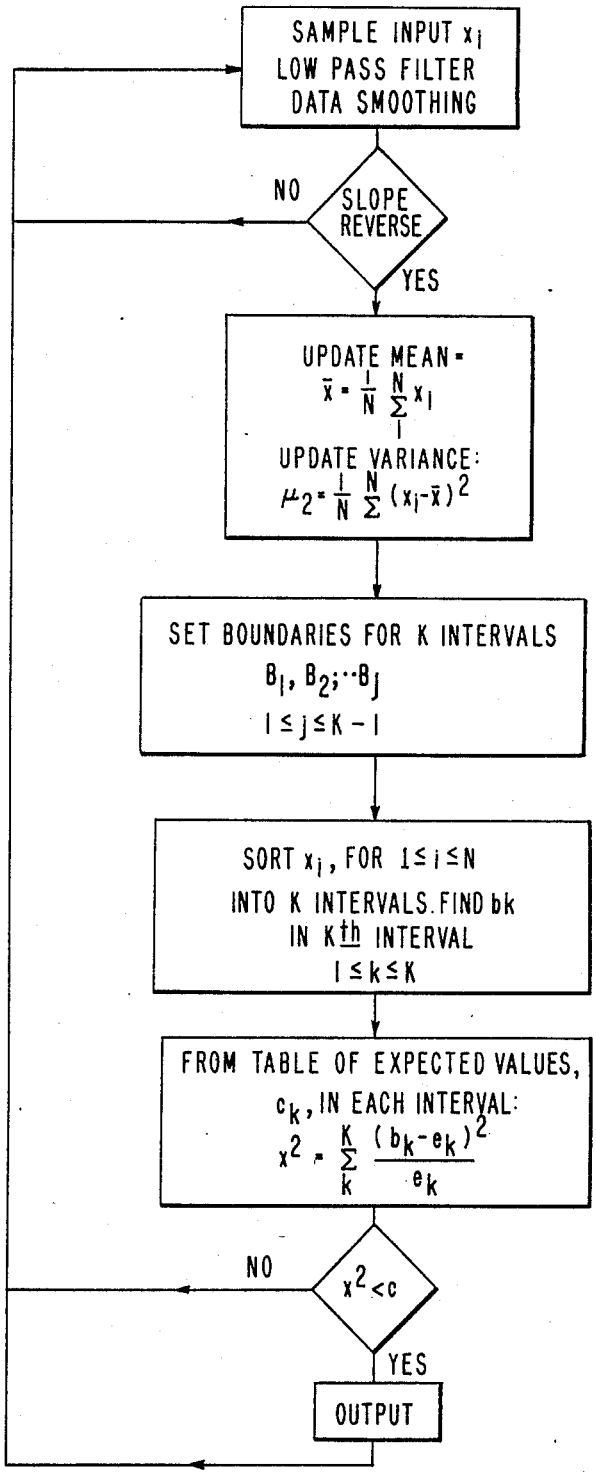
FIG. 18 is a flow diagram representing a Chi-Square Test for fire detection.

FIG. 18 is a flow chart representing the performance of a Chi-Square Test on sampled data from received radiation to detect the presence of a fire. Pre-programmed into FIG. 18 is K, the number of bins to use in calculating Chi-Square. Also pre-programmed into FIG. 18 is the expected number of samples per bin expressed as a percentage of N, the total samples in memory. Thus, knowing $e^j$, the bin edges are calculated in terms of $\bar{x}$ and $\sigma$ and all data points in memory are sorted into the K bins. $b_k$ is then the number of samples sorted into the kth bin. Chi-Square is then calculated and compared to the decision value c, which is also pre-programmed in FIG. 18 by knowing K.

As an example, consider the case from Table 1 for the column headed FIG. 15 where N=20 samples have been taken and K=6 intervals are to be used in testing the hypothesis that they derive from a normal probability distribution with a 95% confidence level. The fire interval boundaries, $B^j$, may be chosen (arbitrarily) to be equally spaced at $\bar{x}-\sigma$, $\bar{x}-\sigma/2$, $\bar{x}$, $\bar{x}+\sigma/2$, and $\bar{x}+\sigma$. From a table of the normal curve of error, the numbers of samples which may be expected to fall into these intervals are: $e_1$ to $e_6$=3.2, 3.0, 3.8, 3.8, 3.0 and 3.2, respectively.

From Table 1 for FIG. 15, the test samples will sort into these same intervals with the following counts $b_1$ to $b_6$=3, 2, 7, 3, 2, and 3, respectively. Chi-Square may be caculated as follows:

$$\chi^2 = \frac{(3.2-3)^2}{3.2} + \frac{(3.0-2)^2}{3.0} + \frac{(3.8-7)^2}{3.8} + \frac{(3.8-3)^2}{3.8} + \frac{(3.0-2)^2}{3.0} + \frac{(3.2-3)^2}{3.2} = 3.48$$

From a Chi-Square table using 3 degrees of freedom at the 95% probability level, the decisional value c=7.81. The example from Table 1 is less than this; therefore the 20 data points in the example are judged to be normally distributed, to a 95% confidence level. For a value of Chi-Square close to c, as in the column for FIG. 13, a decision test may be employed based on the number of data samples in memory. For a number of data samples less than 20 the Chi-Square Test becomes less reliable. Thus, for fewer than 20 samples in memory, the Chi-Square value may be disregarded if in conflict with the Kurtosis/counter test result. For more than 20 data points in memory, the Chi-Square Test output may be combined with that of the Kurtosis/counter test for added reliability.

In summary, the present invention applies statistical analysis to detected radiation signals as a further means for discriminating between fire sources and artificial sources of radiation. By applying this statistical analysis to the radiation in the time domain, the invention provides an added dimension of capability to the frequency domain sensing systems which have been developed heretofore, thereby enabling combinations with such systems to be operated with increased sensitivity by providing added assurance against false alarms. Statistical discriminators in accordance with the present invention provide signal sampling and processing of data in a microprocessor, using selected statistical analysis parameters which are accommodated by the microprocessor. In one method in accordance with the present invention, the true Kurtosis equation is followed. In another method of the present invention, Kurtosis is approximated by a simplified approach with eliminates the need for multiplication, squaring, fourth powers or extracting square roots, operations which slow the processing in the microprocessor. In another method, an up/down counter is used to prevent low frequency signals—which cannot be fires—from confusing the signal processing. In a further method, the Chi-Square test is applied as a further test of the incoming waveform.

Although there have been described above specific arrangements of a fire sensor statistical discriminator in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, such as other tests based on random processing, should be considered to be within the scope of the invention as defined in the annexed claims.

What is claimed is:

1. A statistical discriminator circuit for fire sensing comprising:

a lowpass filter for coupling to a radiation detector which is responsive to radiation in a preselected wavelength range;

peak detector means coupled to the output of said filter for detecting the peaks of the remaining signal components;

means for processing the peak signals to develop respective estimated mean values and mean deviation values of the peak signals;

means coupled to the processing means for combining said peak signals with said estimated mean values and mean deviation values to develop a signal spread level; and means coupled to receive said signal spread level and a corresponding mean deviation value for dividing the signal spread level with the mean deviation value to determine the radiation modulation.

2. The circuit of claim 1 wherein the peak detector means comprise a pair of opposite polarity peak detectors coupled to the output of said filter for separating signal peaks according to polarity and applying opposite polarity peak signals to a pair of parallel signal channels, further including means coupled to the two signal channels for combining said positive and negative polarity peak signals with said estimated mean values to develop signal levels corresponding to the deviation of individual peak signals from the estimated mean value, and means for combining the individual peak signal deviations with said estimated mean deviation value.

3. The circuit of claim 2 further including means coupled between the lowpass filter and the peak detectors for establishing a dead band to inhibit the response of the peak detectors to small signal variations.

4. The circuit of claim 3 wherein said means for establishing a dead band comprise a hysteresis stage coupled to respond to output signals from the lowpass filter, said hysteresis stage having a predetermined level of sensitivity.

5. The circuit of claim 2 wherein each of the two signal channels includes a lowpass filter stage coupled to the output of its corresponding peak detector.

6. The circuit of claim 2 wherein each of the parallel channels is coupled to provide signal inputs to a first pair of amplifiers for developing the estimated mean value and the estimated mean deviation value as respective outputs of said amplifiers.

7. The circuit of claim 6 further including a second pair of amplifiers coupled to receive as respective inputs the estimate mean value and a corresponding one of the positive and negative peak signals from the peak detectors and to provide individual deviation signals corresponding to the deviations of individual peak signals from the estimated mean value.

8. The circuit of claim 7 further including a summing stage for combining said individual deviation signals with the estimated mean deviation value and a lowpass filter coupled to the output of the summing stage for smoothing output signals therefrom to develop the signal spread value.

9. The circuit of claim 1 further including means coupled to the output of the signal spread level dividing means for comparing the modulation with a fixed reference threshold and developing an output signal indicating fire detection for modulation in excess of said reference threshold.

10. The circuit of claim 1 further including an up/-down counter, means for coupling peak signals from the peak detector means to one input of the counter to cause it to count in a first direction, a clock signal coupled to the other input of the counter to cause it to count in a second direction, and a threshold stage coupled to the output of the counter for comparing said output with a preselected reference level and developing a logic TRUE signal upon the count state in said counter exceeding said preselected reference level, thereby signifying detection of a fire.

11. The circuit of claim 10 further including a comparator stage coupled to receive a signal indicative of the radiation modulation for comparing with a preselected reference level and developing a logic TRUE output signifying detection of a fire when the radiation modulation exceeds the reference level of the comparator stage.

12. The circuit of claim 11 further including an AND gate coupled to receive the outputs of the threshold stage and the comparator stage and provide a logic TRUE output signifying detection of a fire upon the concurrence of logic TRUE outputs from said threshold stage and said comparator stage.

13. A fire sensing system including a pair of statistical discriminator circuits each circuit comprising:

a lowpass filter for coupling to a radiation detector which is responsive to radiation in a preselected wavelength range;

peak detector means coupled to the output of said filter for detecting the peaks of the remaining signal components;

means for processing the peak signals to develop respective estimated mean values and mean deviation values of the peak signals;

means coupled to the processing means for combining said peak signals with said estimated mean values and mean deviation values to develop a signal spread level; and means coupled to receive said signal spread level and a corresponding mean deviation value for dividing the signal spread level with the mean deviation value to determine the radiation modulation;

each circuit being coupled to the output of a corresponding detector channel comprising a radiation detector and associated amplifier, the radiation detector in a first of said channels being selected to respond to long wavelength radiation in the range of 7–25 microns and the radiation detector in the other of said channels being selected to respond to short wavelength radiation in a preselected range.

14. The system of claim 13 wherein said preselected range is between 0.8 and 1.1 microns.

15. The system of claim 13 wherein said preselected range is between 1.3 and 1.5 microns.

16. The system of claim 13 further including a cross correlation detector coupled in parallel with the two statistical discriminator circuits for providing a combined output indicating the detection of radiation from a fire.

17. The system of claim 16 wherein the cross correlation detector is coupled to receive signals from both detector channels via separate inputs and to provide a fire detection output in parallel with output signals from the statistical discriminator circuits.

18. The method of discriminating statistically between stimuli from fire and non-fire sources by processing detected radiation in the time domain comprising the steps of:

receiving signals from a radiation detector having a response to radiation within a preselected wavelength range;

filtering said received signals to remove components above a selected frequency;

detecting the peaks of the remaining signal components;

combining the peak signals to develop estimated mean values and mean deviation values of the peak signals;

combining individual peak signals with the estimated mean and the estimated mean deviation values to develop a signal spread level; and dividing the signal spread level by the estimated mean deviation value to provide an output value of radiation signal modulation.

19. The method of claim 18 wherein the detecting step comprises separating the peak signals in accordance with their polarity, further including the steps of filtering the positive peak signals and the negative peak signals separately to develop respective estimated mean values of the positive and negative peak signals, combining an estimated mean value with individual peak signals of opposite polarity to develop respective individual deviation signals for the positive and negative peak signals, and combining said individual deviation signals with the estimated mean deviation value to develop the signal spread level.

20. The method of claim 18 further including the step of comparing the modulation value with a preselected threshold reference level to develop an output indicating the sensing of a fire when the modulation value exceeds said reference level.

21. The method of claim 20 further including combining the output of the modulation comparison with the output of a cross correlator stage coupled to receive signals corresponding to detected radiation in a preselected wavelength range in order to provide a TRUE fire sense signal only upon the concurrence of outputs from the cross correlator and the statistical discriminator stages.

22. The method of claim 20 further including the steps of applying peak signals to one input of a counter to drive the counter in the first direction, applying clock signals at a repetition rate slightly less than said selected frequency to drive the counter in the opposite direction, and comparing the count state of the counter with a predetermined reference level to develop a logic output corresponding to the sensing of a fire when the count state exceeds said reference level.

23. The method of claim 22 further including the steps of combining the logic output from the count comparison with a logic output from the modulation value comparison to develop a logic TRUE signal indicative of fire sensing in the event that both of said combined signals indicate sensing of a fire.

24. The method of claim 23 further including applying a Chi-Square Test to a plurality of peak signals by developing values of Chi-Square for said signals, comparing the value of Chi-Square with a selected reference level, and providing an output signal indicating the sensing of a fire for Chi-Square values less than said reference level.

25. The method of claim 18 wherein said selected frequency is 4 Hz.

26. The method of claim 25 further including the step of establishing a dead band for opposite polarity signals to inhibit the detection of signal peaks for signal changes which are less than a predetermined level.

27. The method of claim 18 wherein the radiation detector is selected to have a radiation response in the range of 7–25 microns.

28. The method of claim 18 wherein the radiation detector is selected to have a radiation response in the range of 0.8–1.1 microns.

29. The method of claim 18 wherein the radiation detector is selected to have a radiation response in the range of 1.3–1.5 microns.

30. The method of discriminating statistically between stimuli from fire and non-fire sources by processing detected radiation in the time domain comprising the steps of:

deriving a series of sequential data signals by sampling detected radiation waveforms in accordance with a preselected parameter;

processing said signals pursuant to at least one selected statistical analysis mechanism to test for the property of randomness of said detected radiation;

comparing the result of said processing with a preselected threshold level; and providing an output indicating the sensing of a fire upon the result of said processing exceeding said threshold level.

31. The method of claim 30 wherein the processing step includes deriving an average value for a selected number of said data signals, utilizing said average value to calculate the variance of said selected number of data signals, and utilizing said average value and said variance to calculate the Kurtosis of said selected number of data signals, and wherein the comparing step comprises comparing the calculated Kurtosis with the preselected threshold level as the basis for indicating the sensing of a fire.

32. The method of claim 31 further including the step of requiring the calculated Kurtosis to exceed said preselected threshold level for a predetermined interval before providing said output indicating the sensing of a fire.

33. The method of claim 32 further including the step, prior to calculating the Kurtosis, of applying said signals, together with clock pulses, to an up/down counter, the output of said counter being applied to a threshold comparator stage for comparison with a predetermined reference level, an output of said threshold comparator stage being used to provide an indication of a fire.

34. The method of claim 32 further including the step of storing said data signals derived within a predetermined time interval in a memory.

35. The method of claim 34 wherein said storing step comprises updating the data stored in memory to retain the stored signals on a first-in, first-out basis.

36. The method of claim 35 wherein said processing step comprises processing those signals stored in memory within a predetermined time interval prior to the time of processing.

37. The method of claim 36 wherein the calculation of said average value, variance and Kurtosis is performed approximately once per second.

38. The method of claim 31 wherein the sampling of a detected radiation waveform is conducted at zero crossings of said waveform.

39. The method of claim 31 wherein the sampling of a detected radiation waveform is conducted at points where the waveform changes slope polarity in order to detect positive and negative peaks of the waveform.

40. The method of claim 31 wherein the sampling of a detected radiation waveform is conducted by detecting the points where the second derivative of the waveform is equal to zero.

41. The method of claim 31 wherein the amplitude distribution of the waveform peaks is selected as the parameter for determining the sampling of the radiation waveform.

42. The method of claim 30 wherein said deriving step comprises detecting changes in slope polarity of a detected radiation waveform and sampling said waveforms upon detection of a slope polarity change to develop said data signals.

43. The method of claim 42 further including the steps of applying said slope polarity change signals to increment a counter and applying clock signals to decrement the counter prior to said signal processing step, the output of said counter being applied to a threshold comparator stage for comparison with a predetermined reference level, an output of said threshold comparator stage being used to provide a indication of a fire.

44. The method of claim 30 wherein the step of processing said signals includes caculating the Kurtosis of a selected series of data signals in order to determine the degree of randomness of a detected radiation waveform as a criterion for providing the output indication of fire sensing.

45. The method of claim 44 further including applying a Chi-Square Test to a plurality of peak signals by developing values of Chi-Square for said signals, comparing the value of Chi-Square with a selected reference level, and providing an output signal indicating the sensing of a fire for Chi-Square values less than said reference level.

46. The method of claim 30 wherein the step of processing said signals includes calculating the spread of the data signals and dividing by the mean deviation to determine the modulation of the detected radiation waveform as a criterion for providing the output indication of fire sensing.

47. The method of claim 46 further including applying a Chi-Square Test to a plurality of peak signals by developing values of Chi-Square for said signals, comparing the value of Chi-Square with a selected reference level, and providing an output signal indicating the sensing of a fire for Chi-Square values less than said reference level.

* * * * *